US008249281B2

(12) United States Patent
Zhang

(10) Patent No.: US 8,249,281 B2
(45) Date of Patent: Aug. 21, 2012

(54) CONDENSER MICROPHONE

(75) Inventor: Rui Zhang, Shenzhen (CN)

(73) Assignees: AAC Acoustic Technologies (Shenzhen) Co., Ltd., Shenzhen (CN); American Audio Components Inc., La Vezne, CA (US)

( * ) Notice: Subject to any disclaimer, the term of this patent is extended or adjusted under 35 U.S.C. 154(b) by 329 days.

(21) Appl. No.: 12/651,455

(22) Filed: Jan. 1, 2010

(65) Prior Publication Data

US 2010/0290648 A1 Nov. 18, 2010

(30) Foreign Application Priority Data

May 15, 2009 (CN) ..... 2009 2 0131473 U

(51) Int. Cl.
*H04R 25/00* (2006.01)

(52) U.S. Cl. ..... 381/174; 381/175; 381/191

(58) Field of Classification Search ..... 381/174, 381/175

See application file for complete search history.

(56) References Cited

U.S. PATENT DOCUMENTS

| | | | | |
|---|---|---|---|---|
| 5,452,268 | A * | 9/1995 | Bernstein | 367/181 |
| 6,901,804 | B2 * | 6/2005 | Torkkeli | 73/716 |
| 7,072,479 | B2 * | 7/2006 | Okita | 381/174 |
| 7,184,563 | B2 * | 2/2007 | Collins | 381/191 |
| 2003/0123683 | A1 * | 7/2003 | Raicevich | 381/174 |
| 2008/0192963 | A1 * | 8/2008 | Sato | 381/174 |
| 2008/0232615 | A1 * | 9/2008 | Song et al. | 381/174 |

* cited by examiner

*Primary Examiner* — Yuwen Pan
*Assistant Examiner* — Taunya McCarty

(57) ABSTRACT

A condenser microphone is disclosed. The condenser microphone includes a substrate having a cavity, a backplate connected to the substrate, a diaphragm facing to the backplate, and an anchor supporting the diaphragm. A first gap is formed between the diaphragm and the backplate. A groove is arranged on the anchor and the diaphragm partially covers the groove. The diaphragm and the groove forms a second gap communicating with the first gap.

3 Claims, 5 Drawing Sheets

CONDENSER MICROPHONE

BACKGROUND OF THE INVENTION

1. Field of the Invention

The present invention generally relates to the art of microphones and, more particularly, to a silicon based condenser microphone.

2. Description of Related Art

Silicon based condenser microphones, known as acoustic transducers, have been researched and developed for more than 20 years. Because of potential advantages in miniaturization, performance, reliability, environmental endurance, low cost, and mass production capability, silicon based microphones are widely recognized to be the next generation product to replace electret condenser microphones (ECM) that has been widely used in communication devices, multimedia players, and hearing aids.

A related silicon based condenser microphone comprises a backplate having a planar plate with a plurality of perforations therein, and a diaphragm parallel and opposed to the backplate for forming a capacitor. The diaphragm can be activated to move along a direction perpendicularly to the planar plate of the backplate.

However, a disadvantage of such microphone is that the air pressure of the air in the gap between the backplate and the diaphragm is unbalanced to that of the air outside. The present invention is provided to solve the problem.

SUMMARY OF THE INVENTION

In one embodiment of the invention, a condenser microphone comprises a substrate having a through cavity, a backplate connected to the substrate, a diaphragm facing to the backplate, and an anchor supporting the diaphragm and isolating the diaphragm from the backplate. A first gap is formed between the diaphragm and the backplate. The anchor defines a plurality of grooves at an inner side thereof. The diaphragm partially covers the grooves for forming a second gap communicating with the first gap.

Other features of the present invention will become more apparent to those skilled in the art upon examination of the following drawings and detailed description of exemplary embodiments.

DETAILED DESCRIPTION OF THE PREFERRED EMBODIMENT

Reference will now be made to describe the exemplary embodiments of the present invention in detail.

Figure 1:
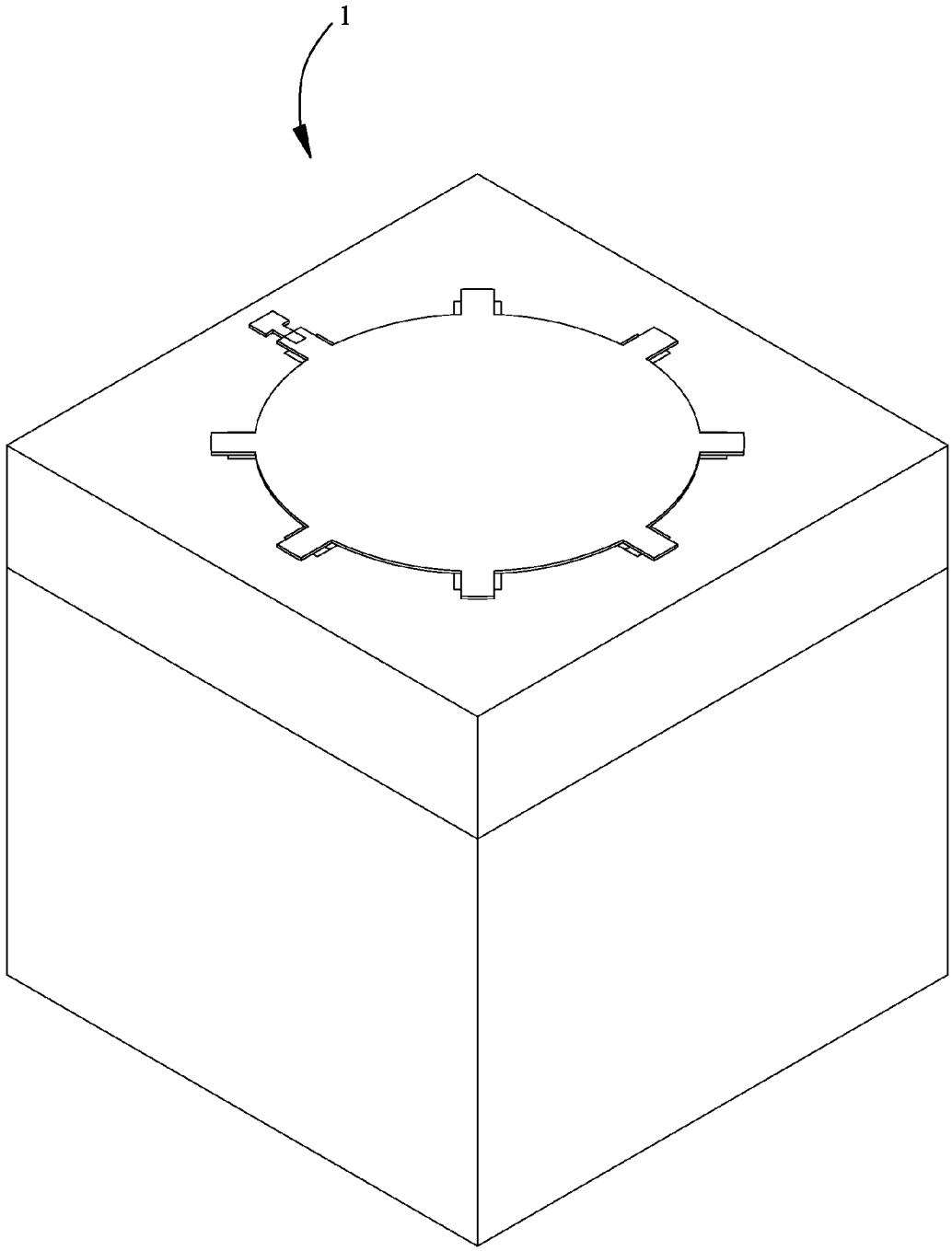
FIG. 1 is an isometric view of a condenser microphone in accordance with one embodiment of the present invention.
Figure 2:
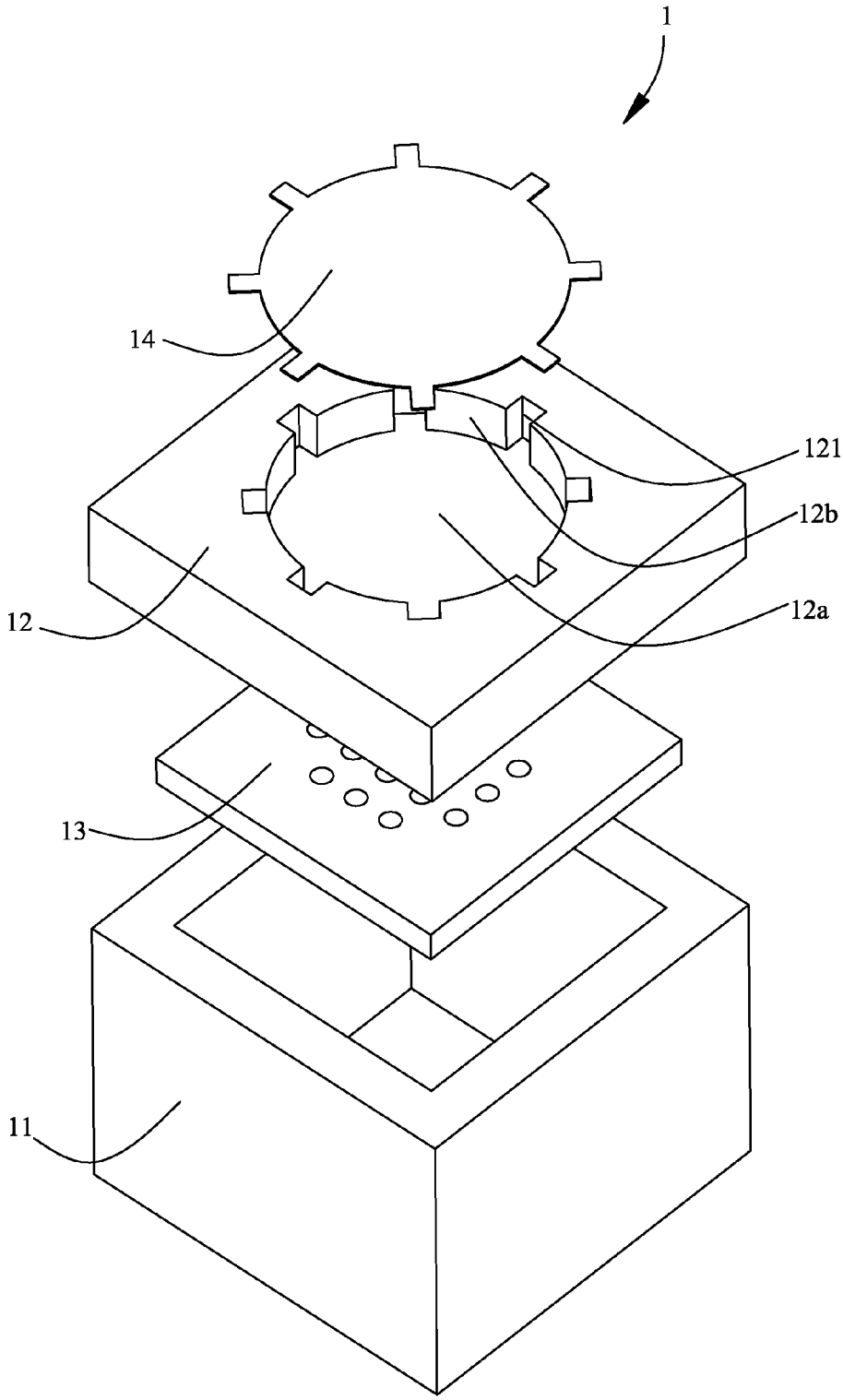
FIG. 2 is an exploded view of the condenser microphone in FIG. 1.

Referring to FIGS. 1-2, a condenser microphone 1 in accordance with a first embodiment of the invention is generally used in a mobile phone for receiving sound waves and then converting the sound waves to electrical signals.

The condenser microphone 1 comprises a substrate 11, a backplate 13 connected to the substrate 11, a diaphragm 14 facing to the backplate 13 and an anchor 12 supporting the diaphragm 11 and isolating the diaphragm 11 from the backplate 13.

Figure 3:
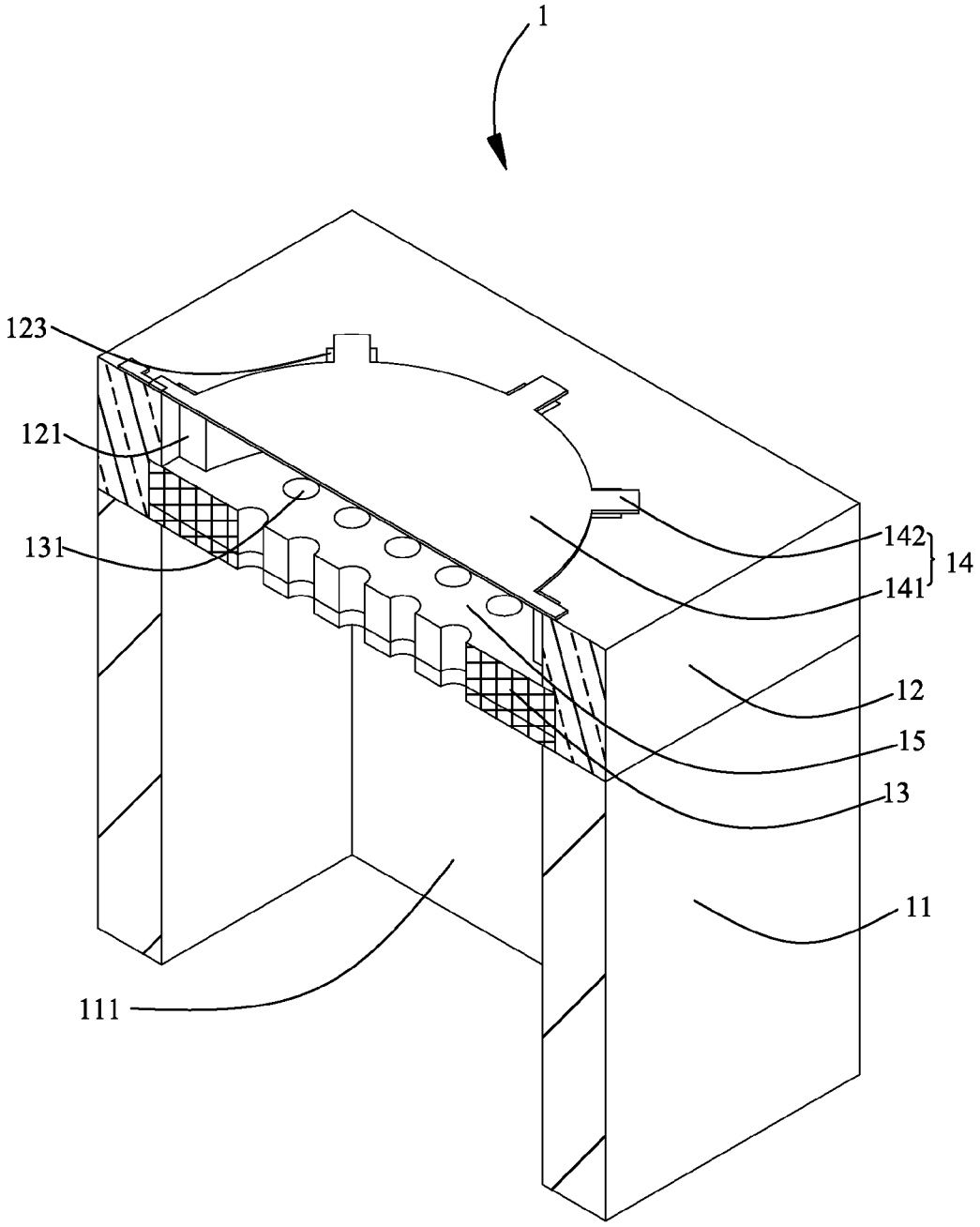
FIG. 3 is an isometric view of the condenser microphone in FIG. 1, half of the microphone being cut off.
Figure 4:
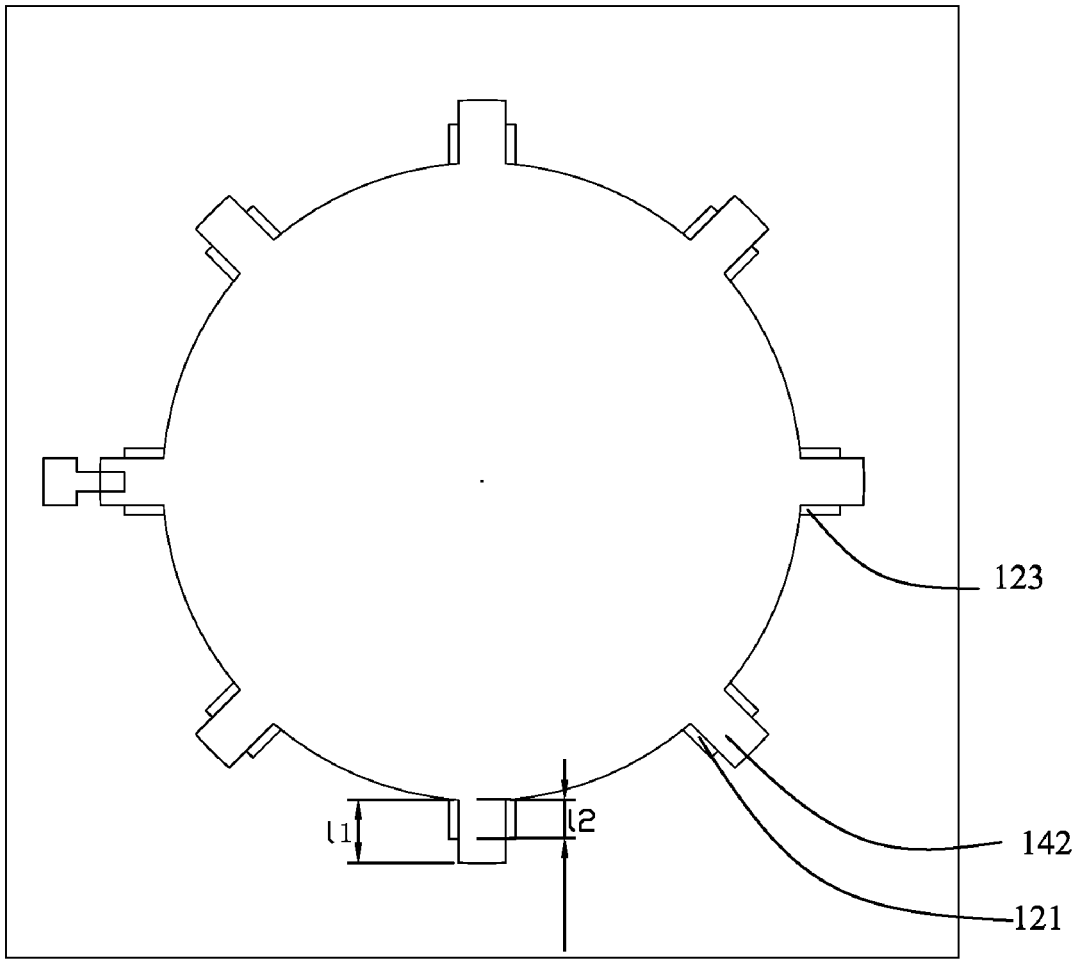
FIG. 4 is a top view of the condenser microphone in FIG. 1.

Referring to FIGS. 3-4, the substrate 11 defines a through cavity 111. The diaphragm 14 faces to the backplate 13 and a first gap 15 is accordingly formed between the diaphragm 14 and the backplate 13. The backplate 13 defines a number of sound holes 131. The diaphragm 14 comprises a vibrating member 141 and a plurality of supporting member 142 radially extending from a periphery of the vibrating member 141 along a direction away from a centre of the diaphragm 14. The supporting member 142 is fixed to the anchor 12 for suspending the diaphragm 14.

Referring to FIGS. 1-4, the anchor 12 defines at least one groove 121. A cavity 12*a* goes through the anchor 12 and the cavity 12*a* defines an inner wall 12*b*. The groove 121 is arranged in the inner wall 12*b*. The supporting member 142 partially covers the groove 121.

Since the supporting member 142 partially covers the groove 121, a second gap 123 is defined there between. The second gap 123 communicates with the first gap 15, which can balance the air pressure of the air in the first gap 15 to that of the air outside.

Referring to FIG. 4, the supporting member 142 defines a first length L1 along a radial direction of the diaphragm 14. The groove 121 defines a second length L2 along the radial direction. The first length L1 is greater than the second length L2, which enables the supporting member 142 to cross the groove 121 for fixing the diaphragm 14 to the anchor 12.

Figure 5:
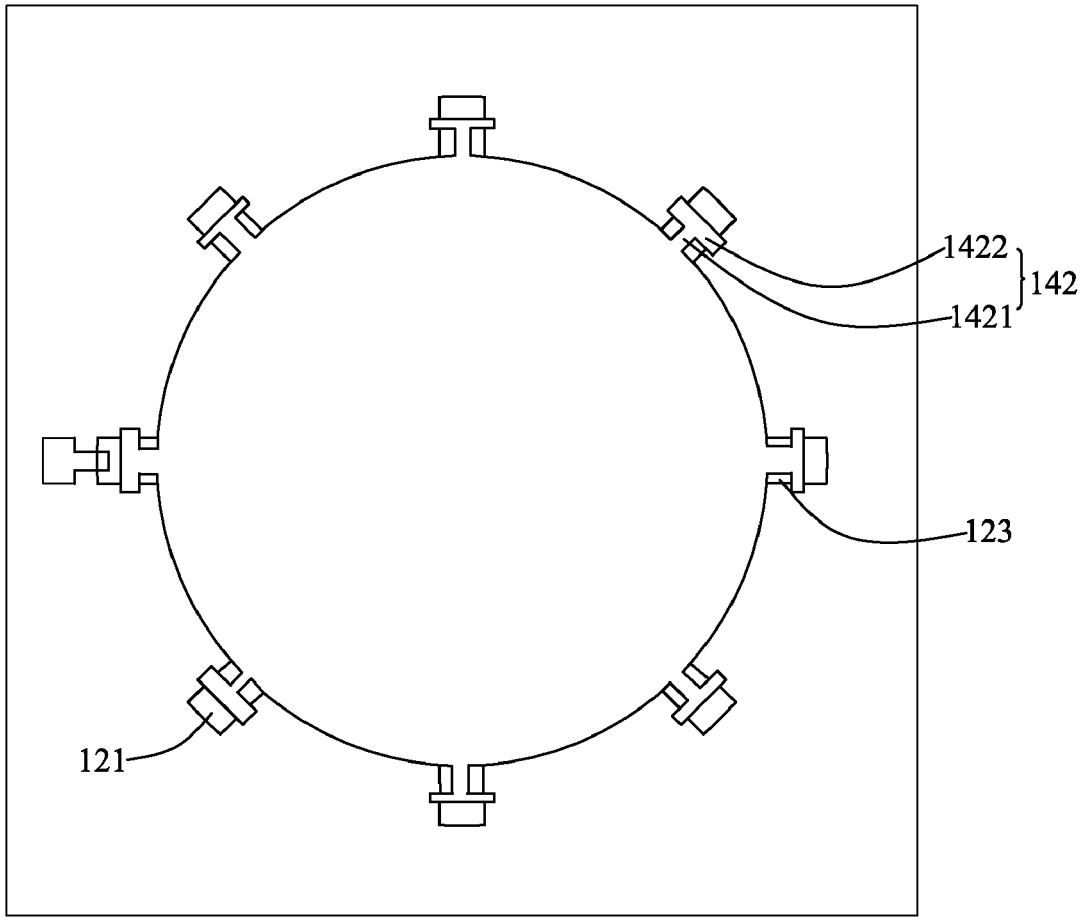
FIG. 5 is a top view of a condenser microphone in accordance with a second embodiment of the present invention.

FIG. 5 illustrates a microphone in accordance with a second embodiment of the present invention the microphone has a supporting member 142 partially covers the groove 121. The supporting member 142 defines a first part 1421 extending along a radial direction of the diaphragm 14 and a second part 1422 extending perpendicular to the radial direction. A middle portion of the second part 1422 is connected to an end of the first part 1421. The second part 1422 strides over the groove 121 and partially covers the groove 121.

When the diaphragm is activated to move relative to the backplate, the vibrating member vibrates perpendicularly to the backplate, while the supporting member does not vibrate, which reduces stress concentrations and improves the performance of resisting impact of the condenser microphone. Such condenser microphone as mentioned above has lower request for the dimension of the second gap, so it predigests the manufacturing process.

While the present invention has been described with reference to a specific embodiment, the description of the invention is illustrative and is not to be construed as limiting the invention. Various of modifications to the present invention can be made to the preferred embodiment by those skilled in the art without departing from the true spirit and scope of the invention as defined by the appended claims.

What is claimed is:

1. A condenser microphone comprising:

a substrate having a through cavity;

a backplate connected to the substrate and having a plurality of sound holes;

a diaphragm opposed to the backplate for forming a capacitor;

a first gap formed between the diaphragm and the backplate;

the diaphragm having a vibrating member and a supporting member extending from the periphery of the vibrating member;

an anchor supporting the diaphragm and isolating the diaphragm from the backplate, the anchor having a cavity in a middle portion and at least one groove, the cavity having an inner wall and the groove being arranged in the inner wall, the groove partially covered by the supporting member of the diaphragm for forming a second gap communicating with the first gap.

2. The condenser microphone as described in claim 1, wherein the supporting member includes a first length along a radial direction of the diaphragm and the groove defines a second length along a radial direction of the cavity, the first length being greater than the second length.

3. The condenser microphone as described in claim 1, wherein the supporting member includes a first part extending along a radial direction of the diaphragm and a second part perpendicular to the first part with a middle portion connected with the first part, the second part strides over the groove.

* * * * *